United States Patent [19]

Centille

[11] 4,136,475

[45] Jan. 30, 1979

[54] SAFETY DEVICE FOR FIREARMS

[76] Inventor: Edward E. Centille, 2 Yorktown Rd., Candlewood Village, DeMonte, Ind. 46310

[21] Appl. No.: 800,639

[22] Filed: May 26, 1977

[51] Int. Cl.[2] ..... F41C 17/00

[52] U.S. Cl. ..... 42/1 LP

[58] Field of Search ..... 42/1 LP, 70 R, 70 E

[56] References Cited

U.S. PATENT DOCUMENTS

| | | | |
|---|---|---|---|
| 633,939 | 9/1899 | Ackerman | 42/1 LP |
| 667,051 | 1/1901 | Ackerman | 42/1 LP |
| 2,945,316 | 7/1960 | Mulno | 42/1 LP |
| 3,553,877 | 1/1971 | Welch et al. | 42/1 LP |

*Primary Examiner*—Charles T. Jordan

[57] ABSTRACT

The invention provides a safety device for firearms wherein a key operated lock actuates a locking pin to lock the firing mechanism. The locking pin is controlled by a rack and pinion gearing linkage which moves the locking pin to alternately engage or disengage a trigger seat.

2 Claims, 2 Drawing Figures

SAFETY DEVICE FOR FIREARMS

BACKGROUND OF THE INVENTION

This invention pertains to locking mechanisms. More particularly this invention pertains to locking mechanisms for firearms. In one particular aspect this invention pertains to locking mechanisms for firearms of the revolver type.

Present day firearms are provided with safety devices to put the weapon in a "safe" position, however, these safety devices are easily manipulated thus defeating the purpose of the device.

Death and injury can result from the accidental discharge of a firearm when the safety device is not in use. There is, therefore, a need for a locking means for firearms which will enable the owner of the weapon to "lock" or disarm the firearm when not in use. Ideally the locking means should provide access to the weapon only by the owner or those authorized to use it, and should not impede the carrying or transporting of the firearm. The prior art locking devices have generally been deficient in the regard.

SUMMARY OF THE INVENTION

Broadly this invention provides for a locking mechanism for firearms e.g. revolvers which comprises a firing mechanism, an opening extending into the revolver which is in communication with the firing pin of the firing mechanism. A key operable lock is installed in the opening with the lock having a key plug. The plug is in rotatable communication via a shaft with an actuating member, e.g. a rack and pinion gear combination or a cam. A locking element e.g. a locking pin is in operable relation to the rack and pinion gear linkage, e.g. the locking pin is mounted for movement in unison with the rack. The pinion gear is connected to the key plug by a rotatable shaft which is joined to and rotates the pinion gear.

In operation when the key is turned the shaft is rotated turning the pinion gear which moves the rack. The movement of the rack causes the locking pin to engage or disengage a recess in the seat of the trigger, and hence either lock or release the seat of the trigger.

DESCRIPTION OF A PREFERRED EMBODIMENT

Figure 1:
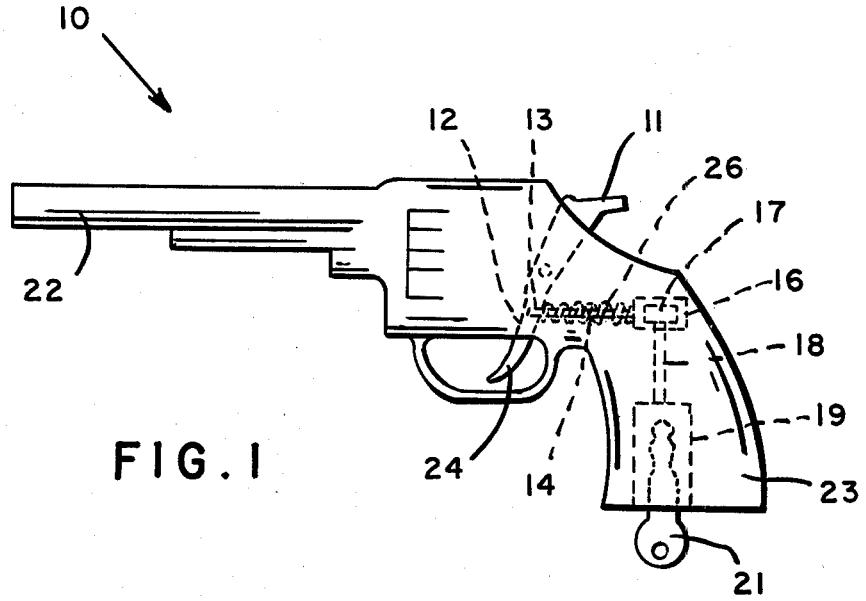
FIG. 1 is a side elevation view of a firearm locking mechanism of this invention in a revolver.

Referring now to FIG. 1 there is shown generally at 10 a revolver having a firing mechanism 11 and a seat of the trigger 12. The seat 12 has a recess 13 which accommodates in sliding engagement a locking pin 14. The locking pin 14 is mounted by conventional means on one end of a rack 16 of a rack and pinion gear linkage. The pinion gear 17 is connected via a shaft 18 to a conventional cylindrical lock 19. A key plug (not shown) within the lock 19 is rotatable by a key 21.

In order to lock the firing seat 12 the key 21 is turned, rotating the key plug which rotates the shaft 18 turning the pinion gear 17 moving the rack 16 toward the front end of the revolver 10. This movement of the rack 16 causes the locking pin 14 to engage the recess 13 in the seat 12, thus preventing any movement of the trigger 24 and effectively locking the firing mechanism.

To release the firing mechanism the position of the key 21 is reversed with the subsequent removal of the locking pin 14 from the recess 13, unlocking the firing mechanism of the revolver 10.

In an embodiment of this invention a spring 26 may be spiraled about the locking pin 14. The spring 26 may be afixed to both the firing seat 12 and the rack 16. The spring 26 prevents any accidental movement of the locking pin 14 when the gun is ready for use by maintaining the rack 16 in a fixed position set by the key 21 when the lock 19 is in the unlocked position.

The above described locking mechanism of this invention may be conveniently received inside of a revolver by an opening in the butt 23. The dimensions of the opening are not critical but should be such as to accommodate the lock 19. The lock 19 may be press-fitted in the butt 23 or secured in place by other conventional means.

The opening in the butt 23 should extend a sufficient depth so as to align the locking pin 14 with the seat 12. Preferably the opening should be provided with a 90° channel, which channel is aligned horizontally with respect to the barrel of the gun. The locking pin 19, spring 26 and rack 26 are mounted for movement in the 90° channel. Preferably the rack 16 is provided with opposing grooves 27 which are mated in sliding engagement to projections (not shown) in the channel. The projections maintain the rack and locking pin in alignment with the seat 12.

While the dimensions of the locking pin 14 are not critical, it has been found that a one-sixteenth" O.D. pin is satisfactory.

It is within the scope of this invention that alternate actuating members other than the rack and pinion gear combination may be utilized in the practice of this invention. For example an eccentric movement such as a cam may be utilized. The cam may be rotatably mounted on the shaft 18. A spring such as spring 26 mounted on the firing seat 12 and biased against the cam may be utilized to maintain the locking pin in place.

Figure 2:
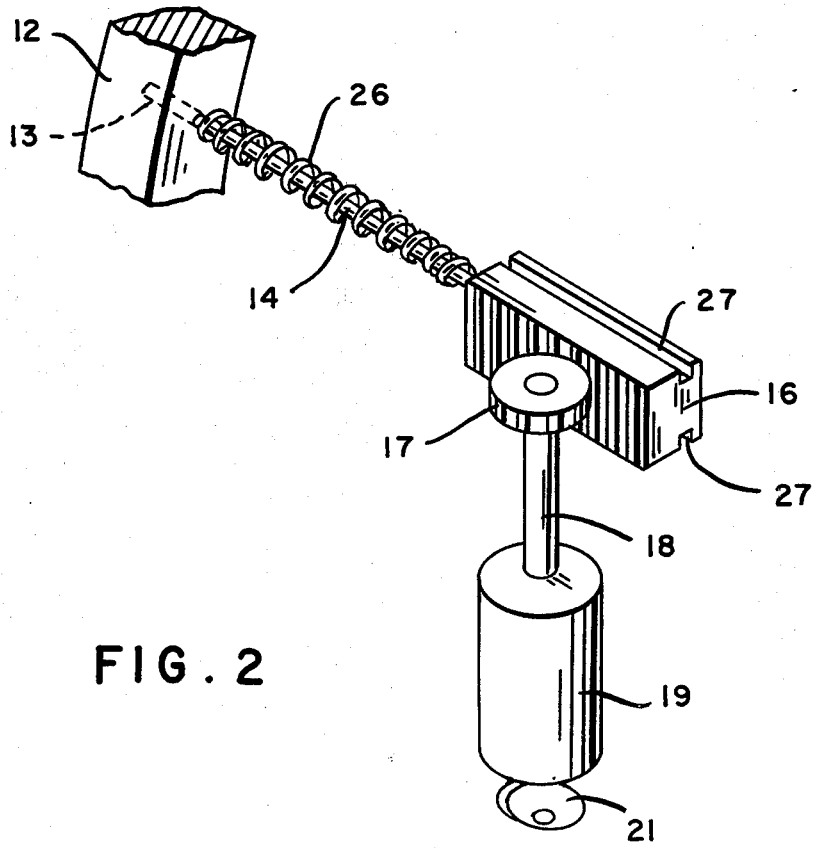
FIG. 2 is an isometric view of the firearm locking mechanism of FIG. 1.

Preferably the lock 19, and the shaft 18 are set vertically with respect to the barrel 22, in the butt 23 of the revolver 10, with the locking pin 14 set horizontally with respect to the barrel 22. Other arrangements of the lock 19 with respect to the locking pin 14 will become apparent to one skilled in the art, such as placing the lock 19 at a right angle to the butt 23. This would necessitate placing the rack 16 at 90° to that depicted in FIG. 2 with the teeth of the rack facing the top of the revolver 10.

It is understood that the inventive concepts set forth are for illustrative purposes and are not to be taken in a limiting sense. This invention may be applied to various other designs of firearms such as rifles and shotguns as may become apparent to those skilled in the art.

What is claimed is:

1. A locking mechanism for firearms comprising a firing mechanism, an opening extending into the firearm and in communication with a seat of a trigger of the firing mechanism, a key operable lock installed in the opening, the lock having a key plug in rotatable communication with a rack and pinion gear linkage activating member, a locking pin mounted for movement in unison with the rack of the rack and pinion gear linkage and in slidable engagement with the trigger seat, the pinion gear mounted for rotation on a shaft which is in rotatable communication with the key plug, the locking pin in slidable engagement with a recess in the trigger seat, a spring spiraled about the locking pin and in operative relation to both the trigger seat and the rack, the locking pin selectively locking and unlocking the trigger seat in response to the operation of the key lock.

2. The locking mechanism according to claim 1 wherein the lock is cylindrical.

* * * * *